US007634865B2

(12) United States Patent
L'Hôtel

(10) Patent No.: US 7,634,865 B2
(45) Date of Patent: Dec. 22, 2009

(54) VERY SIMPLE INFORMATION PRESENTATION SUPPORT AND METHODS FOR ASSEMBLY AND DISASSEMBLY OF SAID SUPPORTS

(76) Inventor: François L'Hôtel, Le Moulin á Vent, Larchant (FR) 77760

( * ) Notice: Subject to any disclaimer, the term of this patent is extended or adjusted under 35 U.S.C. 154(b) by 0 days.

(21) Appl. No.: 11/576,869

(22) PCT Filed: Oct. 5, 2005

(86) PCT No.: PCT/FR2005/002452

§ 371 (c)(1),
(2), (4) Date: Sep. 4, 2007

(87) PCT Pub. No.: WO2006/040438

PCT Pub. Date: Apr. 20, 2006

(65) Prior Publication Data

US 2007/0294925 A1 Dec. 27, 2007

(30) Foreign Application Priority Data

Oct. 8, 2004 (FR) ..... 04 10627

(51) Int. Cl.
*G09F 15/00* (2006.01)

(52) U.S. Cl. ..... 40/610; 40/539

(58) Field of Classification Search ..... 40/124.07, 40/124.09, 124.14, 539, 606.12, 606.18, 40/610, 750, 787, 650, 738; 248/174, 459; 229/107

See application file for complete search history.

(56) References Cited

U.S. PATENT DOCUMENTS 1,545,771 A * 7/1925 Hout ..... 229/107
1,576,672 A 3/1926 Miller
1,987,418 A * 1/1935 Plishker et al. ..... 40/539
2,407,592 A 9/1946 Wathen
4,235,032 A * 11/1980 Robinson ..... 40/539
5,454,180 A * 10/1995 Volpe ..... 40/539
5,592,768 A * 1/1997 Testa ..... 40/786
5,787,621 A * 8/1998 Leksell ..... 40/607.03

(Continued)

FOREIGN PATENT DOCUMENTS

CH 665 760 A5 6/1988

(Continued)

*Primary Examiner*—William L. Miller
(74) *Attorney, Agent, or Firm*—Novak Druce+Quigg; J. Rodman Steele, Jr.; Gregory M. Lefkowitz

(57) ABSTRACT

Information display medium (1) having at least two display faces, one on each of two blank parts (2, 3) made of a substantially rigid and foldable material, the blank parts (2, 3) being arranged so that, when the medium is unfolded, they are stressed so as to stress the display faces, a plurality of holding inserts, which act at various different points along said display faces, being provided to keep the display faces stressed. The blank parts (2, 3) of the display faces are joined together by their edges (14, 19), each holding insert (21) is mounted between the blank parts (2, 3) in a variable position that can switch between a position in which the medium is collapsed and a position in which the display faces of the blank parts (2, 3) of the medium are kept in the stressed state, each insert (21) being associated with a mechanism for locking it in its holding position.

17 Claims, 8 Drawing Sheets

U.S. PATENT DOCUMENTS

| | | | | |
|---|---|---|---|---|
| 5,966,857 | A * | 10/1999 | Pettersson et al. | 40/606.12 |
| 6,347,772 | B1 * | 2/2002 | L'Hotel | 248/174 |
| 7,134,230 | B1 * | 11/2006 | Boens et al. | 40/610 |
| 7,159,350 | B2 * | 1/2007 | L'Hotel | 40/610 |
| 2002/0171023 | A1 | 11/2002 | L'Hotel | |
| 2007/0245610 | A1 * | 10/2007 | Armengol et al. | 40/610 |

FOREIGN PATENT DOCUMENTS

| | | | |
|---|---|---|---|
| DE | 299 00 444 | U1 | 6/1999 |
| FR | 2 770 320 | A | 4/1999 |
| GB | 436 046 | A | 10/1935 |

* cited by examiner

VERY SIMPLE INFORMATION PRESENTATION SUPPORT AND METHODS FOR ASSEMBLY AND DISASSEMBLY OF SAID SUPPORTS

FIELD OF THE INVENTION

The invention relates to information display media for visual communication or advertising at points of sale (APOS). The display units of the invention are columns which can be folded up on themselves and unfolded as well as being, advantageously, ideally suited to transport and storage, on the one hand, and very quick to install on site, on the other.

More specifically, the invention relates to an information display medium having at least two display faces, one on each of two blank parts made of a substantially rigid and foldable material, the blank parts being arranged so that, when the medium is unfolded, they are stressed so as to stress the display faces, a plurality of holding inserts, which act at various different points along said display faces, being provided to keep the display faces stressed.

BACKGROUND OF THE INVENTION

Such a display medium is already known, in particular from FR 2 824 946, this medium comprising, as means for stressing the blank parts, elastic members and, as holding inserts, holding strips acting in opposition to the elastic members and which, when the display unit is deployed, abut against abutment flaps of the blank parts and are hinged to hinge flaps of the blank parts.

With such a prior art display medium, from a folded state, it is sufficient to start to unfold the medium so that, under the action of the stressing elastic members, it automatically unfolds completely. Naturally, in reverse, the medium is folded up against the action of the stressing elastic members.

However, such a medium has features that may, in certain situations, not be appreciated by everyone.

To be precise, it is a display unit that could be described as top of the range. It is relatively difficult to erect and, overall, expensive.

SUMMARY OF THE INVENTION

The applicant has therefore sought to develop a very simple display medium which is more generally affordable and more durable, and this is what is proposed by the invention.

It thus consists of a display medium of the type defined above, characterized in that the blank parts of the display faces are joined together by their edges, each holding insert is mounted between the blank parts in a variable position that can switch between a position in which the medium is collapsed and a position in which the display faces of the blank parts of the medium are kept in the stressed state, each insert being associated with means for locking it in its holding position.

As claimed above, the display medium is very simple, both to use and make.

In the preferred embodiment of the medium of the invention, the means for locking a holding insert are also designed to release it from its holding position and allow the blank parts to be flattened and the medium to be collapsed.

Advantageously, each insert comprises a bridge made of substantially rigid, foldable material designed to be folded on itself along two secant fold lines.

In this case, it is advantageous for the bridge portion extending on one side of one of the two fold lines to be fixed to the blank parts, to constitute the holding insert, the other of the two fold lines being substantially parallel to the edges of the blank parts and lying in the same plane as these edges, and the bridge portion extending on the other side of said fold line constituting a lever for locking/releasing the insert portion of the bridge in/from its holding position.

It is also advantageous for the bridge portion extending on one side of one of the two fold lines to be fixed to the blank parts, to constitute the holding insert, the other of the two fold lines lying in the same plane as the edges of the blank parts, perpendicular to these edges in the folded state, and the bridge portion extending on the other side of said fold line constituting a lever for locking/releasing the insert portion of the bridge in/from its holding position.

Advantageously, the lever portion of the bridge comprises means for automatically folding along said one fold line in one direction or the other.

Preferably, the type of material used to make the locking/release bridge is determined so as to allow the lever portion of the bridge to fold under its own weight.

Thus, to unfold the display medium, it is sufficient to stress its blank parts to stress the display faces, which unfolds the holding and locking/release bridges and renders them flat, to enable them to hold faces in the stressed state, before, if necessary assisted by a slight shaking movement, the lever portions of the bridges pivot into the position for locking the holding portions.

To close and fold up the medium, it is sufficient to turn it upside down to cause the lever portions of the bridges to pivot in the other direction until the latter are flat once more, allowing them to fold along their fold line which lies in the same plane as the edges of the blank parts, and allowing the two blank parts to collapse down on top of one another, before folding up the medium.

These are two ways of erecting and collapsing the medium of the invention which the applicant also wishes to claim.

BRIEF DESCRIPTION OF THE DRAWINGS

The invention will be more clearly understood with the aid of the following description of several embodiments of the display medium, and how it is erected and collapsed, with reference to the attached drawings, in which.

DETAILED DESCRIPTION OF THE INVENTION

Figure 1:
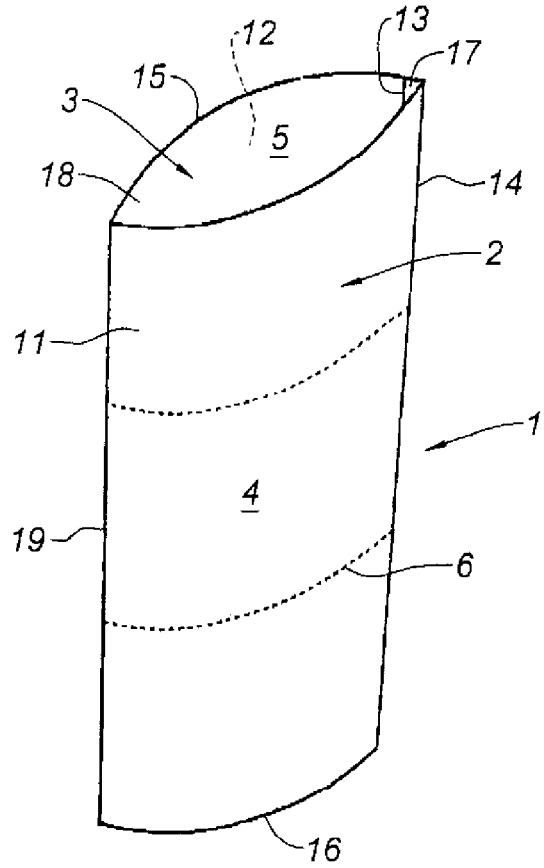
FIG. 1 is a perspective view of a first embodiment of the display medium, in the deployed state.

The display medium of FIG. 1 is in the form of a deployed vertical column 1 with two blank parts 2, 3 made out of a single starting blank of relatively light cardboard or of paperboard, which is a rigid, foldable material. Each blank part 2, 3 is divided into panels 4, 5, three in this case, which are adjacent along thick fold lines 6, of which there are two in this case. All the panels 4, 5 are identical. The front faces of the panels 4, 5 constitute the information display faces 11, 12 of the column medium. The column of FIG. 1 can be collapsed by folding the panels 4, 5 down on top of one another.

The starting blank, rectangular in shape, had two free side edges 13, 14 and two transverse edges 15, 16. A side flap 17 was formed along one of the side edges 13, on the other side of a fold line which, in FIG. 1, lies along the side edge 14.

The flap 17 was fixed, by adhesive bonding in this case, to the adjacent strip along the lateral edge 14 of the rear face 18 of the blank part 3. The starting blank was folded along a fold line 19 parallel to the side edges 13, 14 in such a way that the two blank parts 2, 3 are identical and both lie between their side edges 19, 14 and 14, 19.

Figure 7:
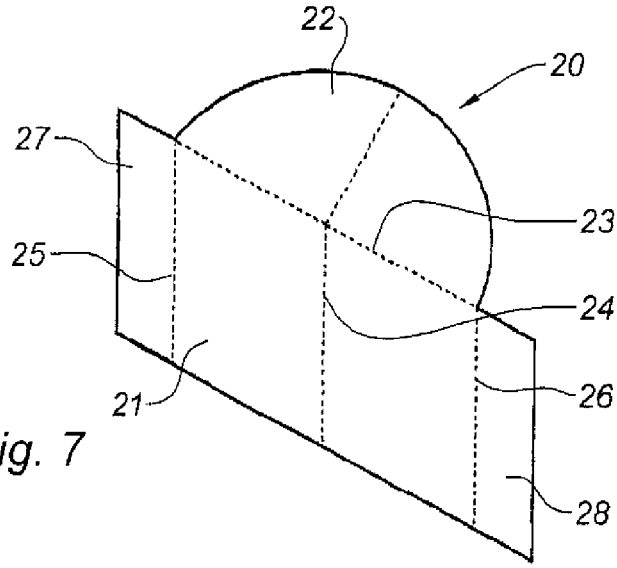
FIG. 7 is a perspective view of the insert of FIG. 6, in its locking position.
Figure 6:
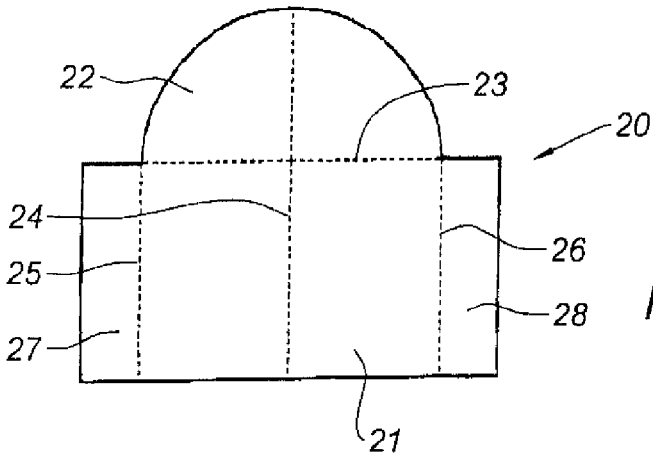
FIG. 6 is a view of the insert of FIG. 5, when flat.
Figure 5:
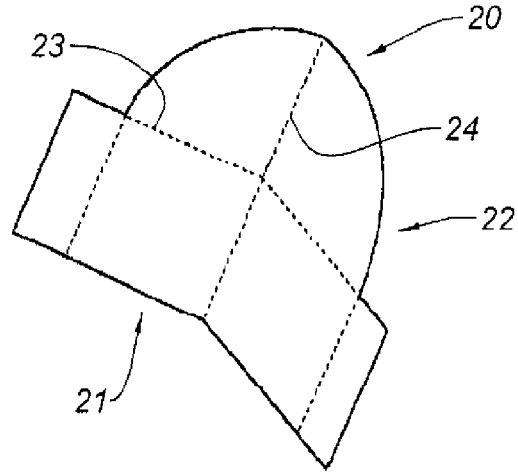
FIG. 5 is a perspective view of a holding and locking insert, as the medium of FIG. 1 is being deployed.
Figure 9:
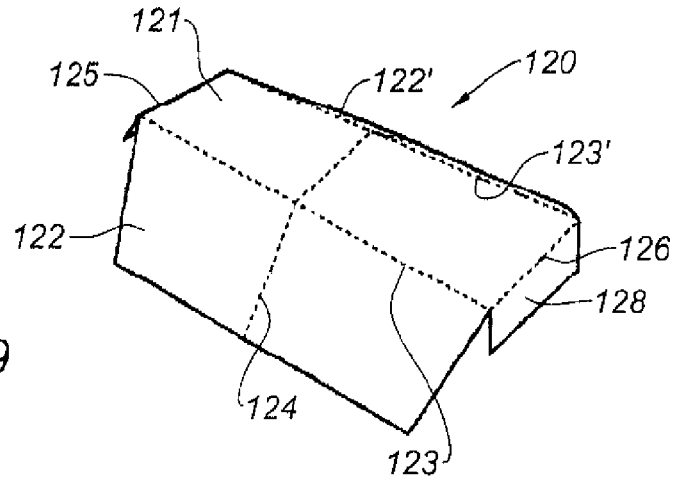
FIG. 9 is a perspective view of the insert of FIG. 8, in its locking position.
Figure 8:
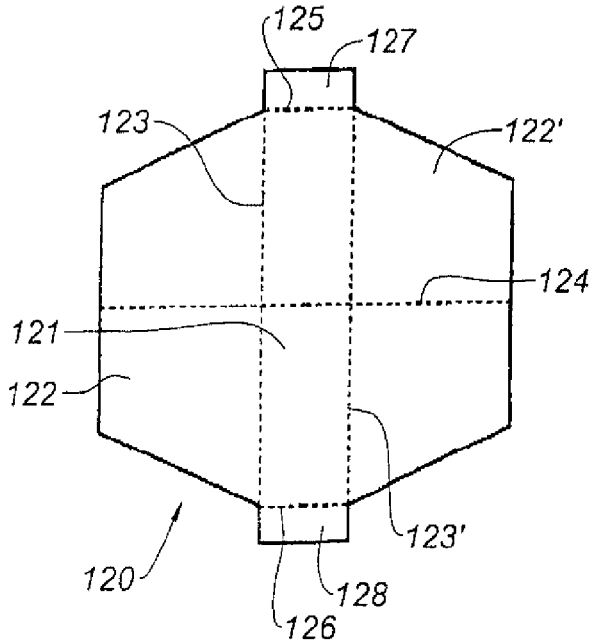
FIG. 8 is a view, when flat, of a holding and locking insert of a second embodiment of the display medium.
Figure 10:
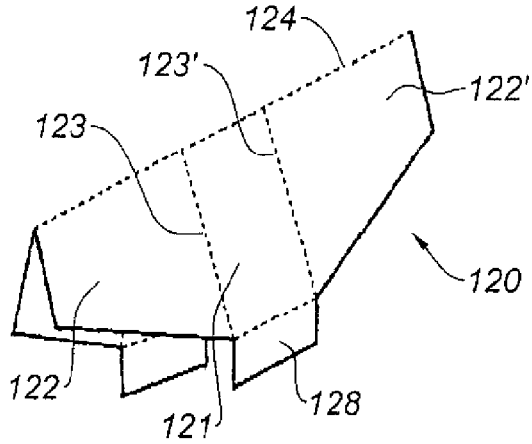
FIG. 10 is a perspective view of the insert of FIG. 8, as the medium is being deployed.

The column 1 comprises, in this case one per pair of same-level panels 4, 5 of the two blank parts 2, 3, a holding and locking/release insert 20 (FIGS. 5-7). It consists of a bridge which is also made out of a flat blank portion made of rigid, foldable material of the same type as the blank of the column medium and in this case has a complex shape. A first rectangular part 21 performs a holding function while a second substantially semi-circular part 22 performs a locking/release function. The two parts are separated from one another by a first fold line 23. The bridge may also be folded along a second fold line 24, cutting the first, in this case at a right angle, and running parallel to the two effective side edges 25, 26 of the holding part 21 at a substantially equal distance from the two. The fold line 23 corresponds substantially to a diameter of the semi-circular part 22, the diameter being substantially equal to the length of the holding part 21 between its edges 25, 26. Beyond the effective side edges 25, 26, the holding part 21 is extended by two strips 27, 28 designed, after folding along "border" lines 25, 26, to be adhesively bonded to the rear faces 18 of the blank parts 2, 3, to fix the inserts in place.

The first part 21, the "holding" part, of the bridge 20 can be described as a holding insert 21 while the other part, as we will now see, can be described as a lever 22 for locking/releasing the insert 21 in/from its holding position.

From a flat state (FIG. 6), the bridge 20 can be folded in two, either i) along the first line 23 (FIG. 7) with the holding insert 21 on one side and the lever 22 on the other, or ii) along the line 24 (FIG. 5), with the first halves of the insert and lever on one side and the second halves of the insert and lever on the other. Because the two fold lines 23, 24 are secant, the bridge 20 can only be folded along one of the two fold lines, and the bridge portions lying on either side of a fold line can only be flat.

Thus, when the lever part 22 is pivoted about the fold line 23 (FIG. 7), the holding part 21 cannot be folded on itself along the line 24, and the part 21 is locked in the holding position, as will be seen more clearly below. Conversely, if the lever part 22 is pivoted back in the other direction about the line 23, until the bridge 20 returns to its flat state, i.e. if the holding insert 21 is released, then the bridge 20 can be folded along the line 24 to allow the column 1 to be flattened and collapsed.

More specifically in the present case, the quality and type of material used for the bridge 20 allow the lever part 22 to be folded along the first fold line 23, in either direction, which we shall call automatic or, optionally, semi-automatic, thanks to the weight of this lever part 22.

Thus, a holding insert 20, 21 is fixed at each panel level of the column 1. Each insert is mounted between the two blank parts 2, 3 against their rear faces 18, to which the insert's two side strips 27, 28 are fixed, in this case by adhesive bonding, the two effective side edges 25, 26 of the inserts in this case running parallel to the side edges 14, 19 of the column 1.

In other words, the two blank parts 2, 3 are joined to one another by a plurality of identical holding inserts 21, which act at various different points along the display faces 11, 12.

Thus, the column 1 is erected and collapsed as follows.

Erecting the Column

Figure 4:
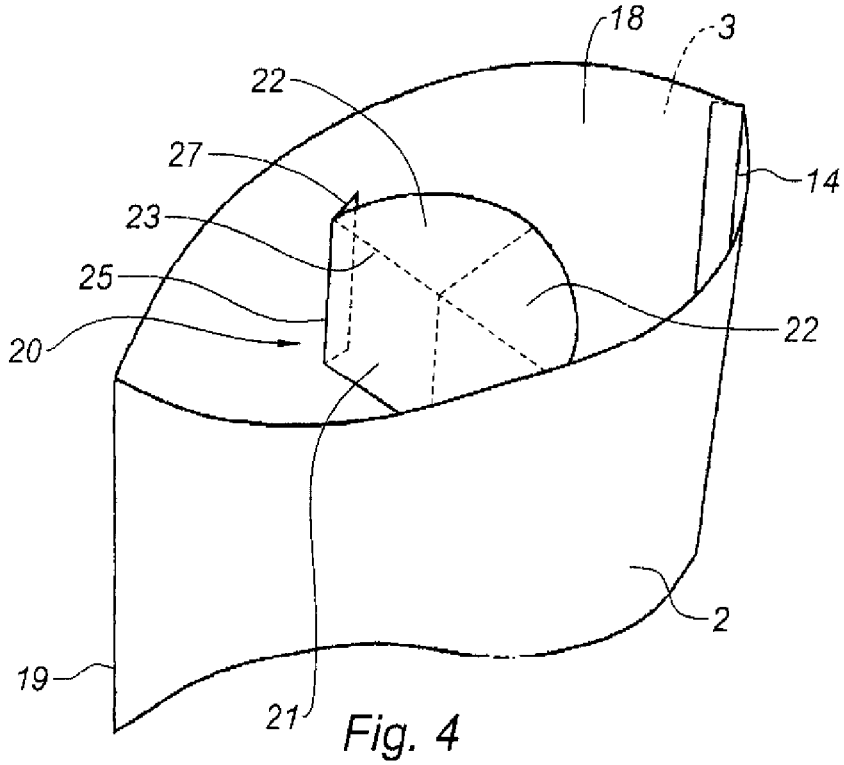
FIG. 4 is a perspective view of the panels of FIG. 3, after locking.
Figure 3:
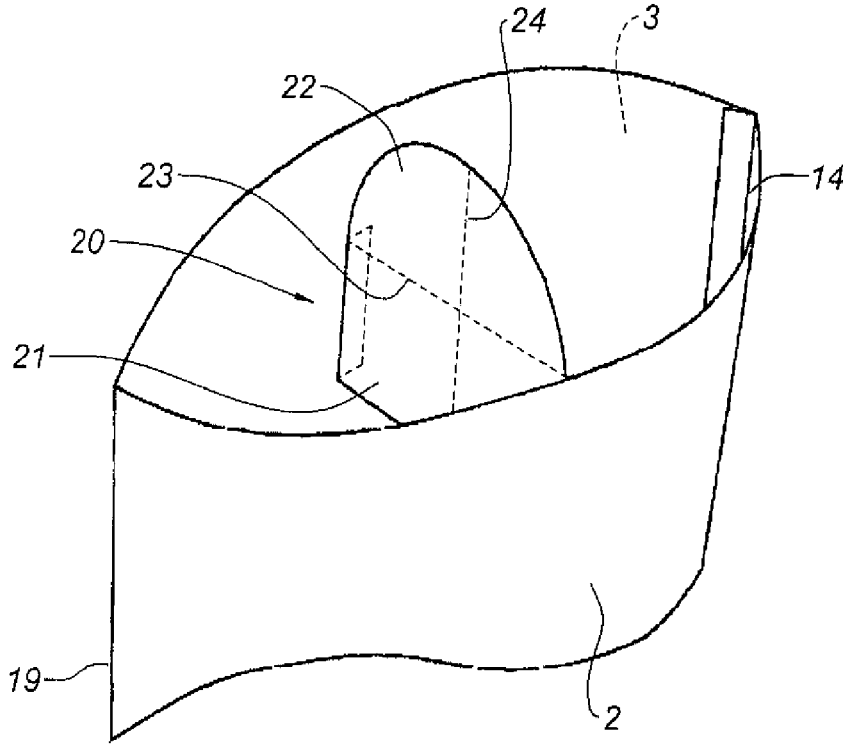
FIG. 3 is a perspective view of the panels of FIG. 2, after deployment but before locking.
Figure 2:
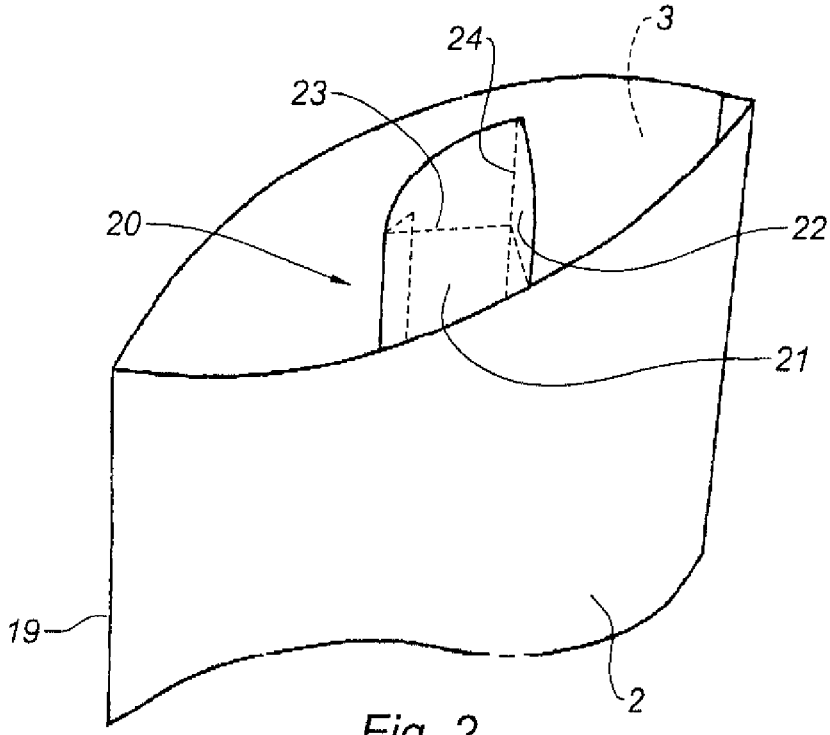
FIG. 2 is a perspective view of the upper panels of the display medium of FIG. 1, during deployment.

With the column 1 collapsed, the two blank parts 2, 3 flat, their rear faces 18 against one another, the pairs of panels 4, 5 also folded down on top of one another along the fold lines 6, the column 1 is deployed by manually stressing the blank parts 2, 3 by pressing on the side edges 14, 19, which brings the latter closer together and stresses the blank parts 2, 3 and, with them, the display faces 11, 12. Concomitantly, the inserts 21, folded along their fold line 24 (FIG. 2), are also unfolded until they lie flat (FIG. 3). Then, maintaining the pressure on the side edges 14, 19 of the column, shaking the medium slightly if necessary, the lever parts 22 of the inserts are made to pivot automatically, or semi-automatically, under their own weight, into their locking position (FIG. 4). With the holding inserts 21 thus locked in their flat state by the levers 22, the pressure on the side edges 14, 19 can be released; the inserts 21 hold the display faces 11, 12 in their stressed state, curved in this case.

Collapsing the Column

The column 1 is turned upside down to cause the lever parts 22 to pivot in the other direction under their own weight, until the bridges 20 are flat once more (FIG. 3). This allows the inserts 21 to be folded along their fold line 24, which is parallel to the side edges 14, 19 of the column and lies in the same plane as these edges, and thus allows the blank parts 2, 3 to be collapsed down and flattened, one against the other, before folding the pairs of panels 4, 5 on top of one another along the fold lines 6, on either side, accordion-fashion, and the assembly can then be kept thus folded-up by any appropriate means, for example an elastic member.

Holding inserts 21 associated with locking/release levers 22 designed to pivot under their own weight have been described. Locking/release levers that pivot under the action of an integrated weight could also be envisaged. In light of the objective stated earlier, this solution would obviously be less advantageous.

The embodiment 101 of the display medium of FIGS. 8-13 differs from the first only by virtue of its holding and locking/release bridges 120 which are shaped so as to form columns with more than two display faces. Thus, the elements of the second embodiment which are similar to those of the first embodiment will bear the same reference numbers as them, increased by 100.

The bridges 120 comprise a holding part 121 but two locking/release parts 122, 122' extending out from the fold lines 123, 123' and forming, when the column is deployed, edges of the holding part 121.

The holding and locking/release inserts 120 are made like the inserts 20, but are shaped and fixed to the column differently.

When flat (FIG. 8), the holding part is still rectangular but the locking/release parts or levers 122, 122' are trapezoidal, with a large base lying along the fold line 123, (123'). The bridge 120 may also be folded along a third fold line 124 which, in this case too, also cuts the lines 123, 123' at a right angle. The holding part 121, beyond its effective side edges 125, 126, which are perpendicular to its fold edges 123, 123', is extended by two strips 127, 128 designed, after folding along border lines 125, 126, to be adhesively bonded to the rear faces 118 of the blank parts 102, 103, to fix the inserts in place.

From a flat state (FIG. 8), the bridge 120 can be folded in three, either i) along the two fold lines 123, 123' (FIG. 9), with the holding insert 121 in the centre and the levers 122, 122' on either side, or ii) along the fold line 124 (FIG. 10), with the first halves of the insert 121 and levers 122, 122' on one side and the second halves of the insert and levers on the other.

As for the bridges 20, the bridges 120 can only be folded along the lines 123, 123' or 124.

Thus, when the lever parts 122, 122' are pivoted about the fold lines 123, 123' (FIG. 11), the holding part 121 cannot be folded on itself along the fold line 124, and the part 121 is locked in the holding position, as will be seen more clearly below. Conversely, if the lever parts 122, 122' are pivoted back in the other direction about the lines 123, 123', until the bridge 120 returns to its flat state, i.e. if the holding insert 121 is released, then the bridge 120 can be folded along the line 124 to allow the column 101 to be flattened and collapsed.

As for the bridges 20, the lever parts 122, 122' of the bridges 120 fold semi-automatically.

Thus, a holding insert 120, 121 is fixed at each panel level of the column 101. Each insert is mounted between the two blank parts 102, 103 against their rear faces 118, to which the insert's two side strips 127, 128 are fixed, in this case by adhesive bonding, the two effective side edges 125, 126 of the inserts in this case running orthogonally to the side edges 114, 119 of the column 101, i.e. in a plane perpendicular to these edges.

In other words, the two blank parts 102, 103 are joined to one another by a plurality of identical holding inserts 121, which act at various different points along the display faces 111, 112.

Note that in this case the fold line 124, which makes it possible to collapse and deploy the column, lies in the same plane as the two side edges 114, 119 of the column.

Thus, the column 101 is erected and collapsed as follows.

Erecting the Column

Figure 11:
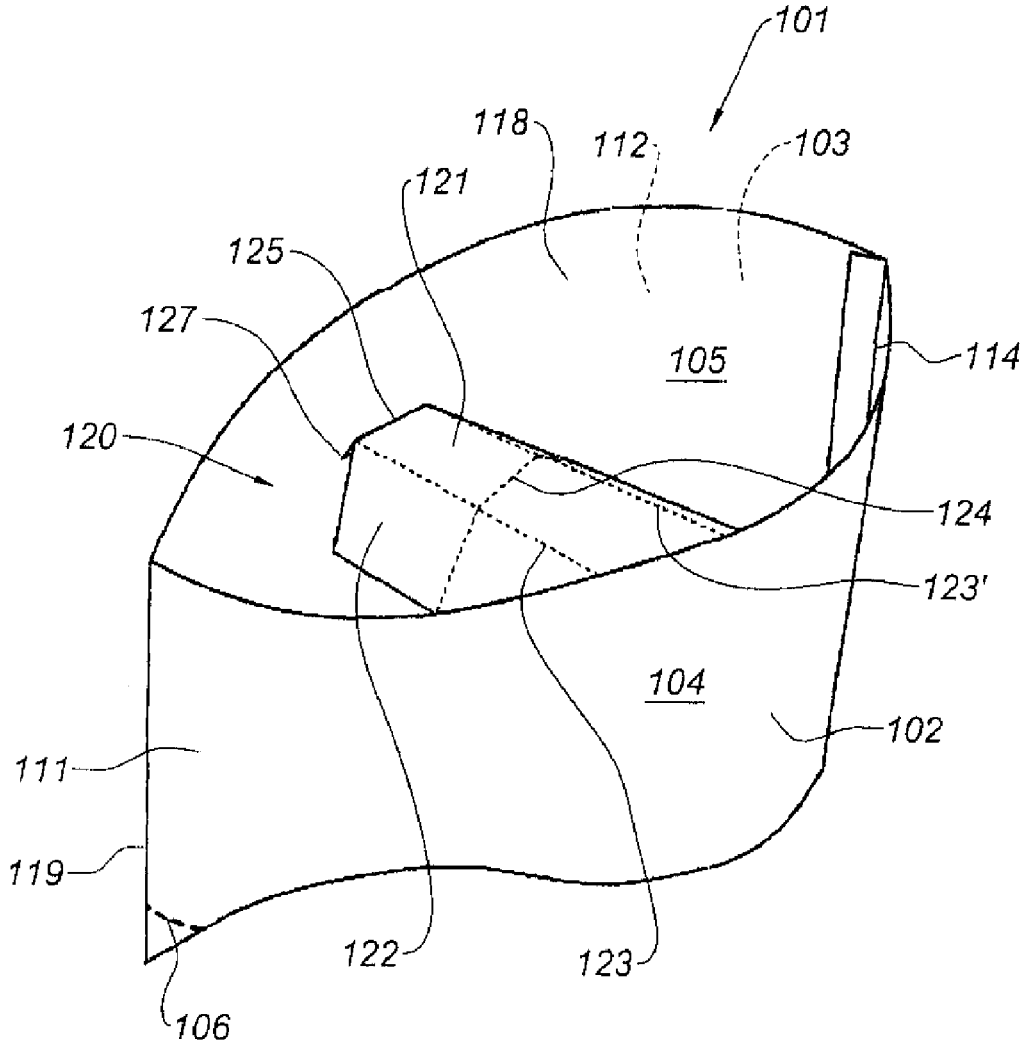
FIG. 11 is a perspective view of the upper panels of the second embodiment of the display medium, in the deployed state.
Figure 12:
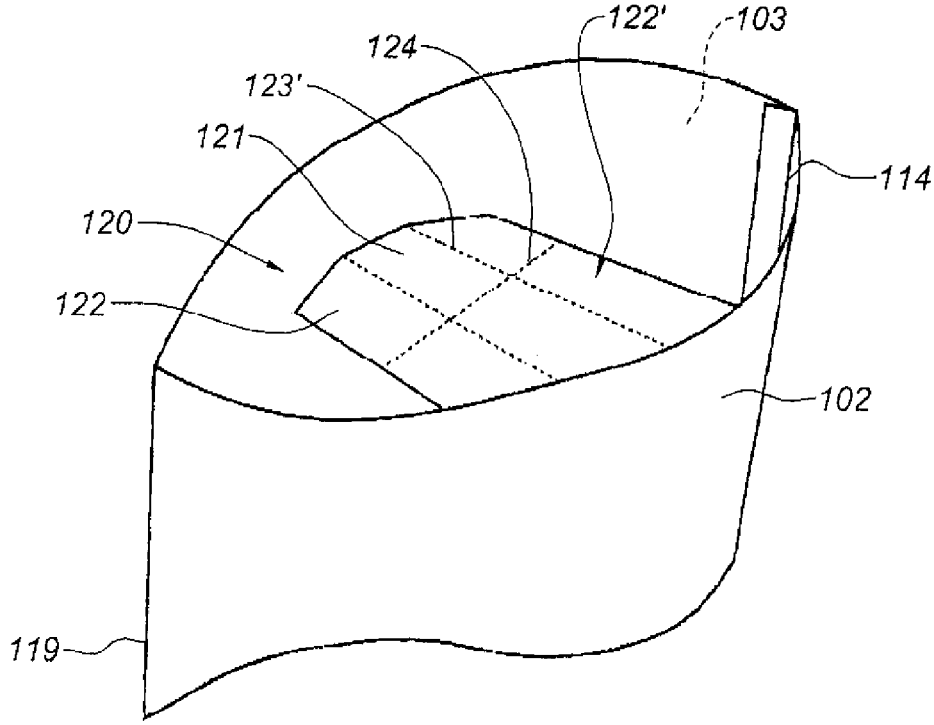
FIG. 12 is a perspective view of the upper panels of FIG. 11, after deployment but before locking.
Figure 13:
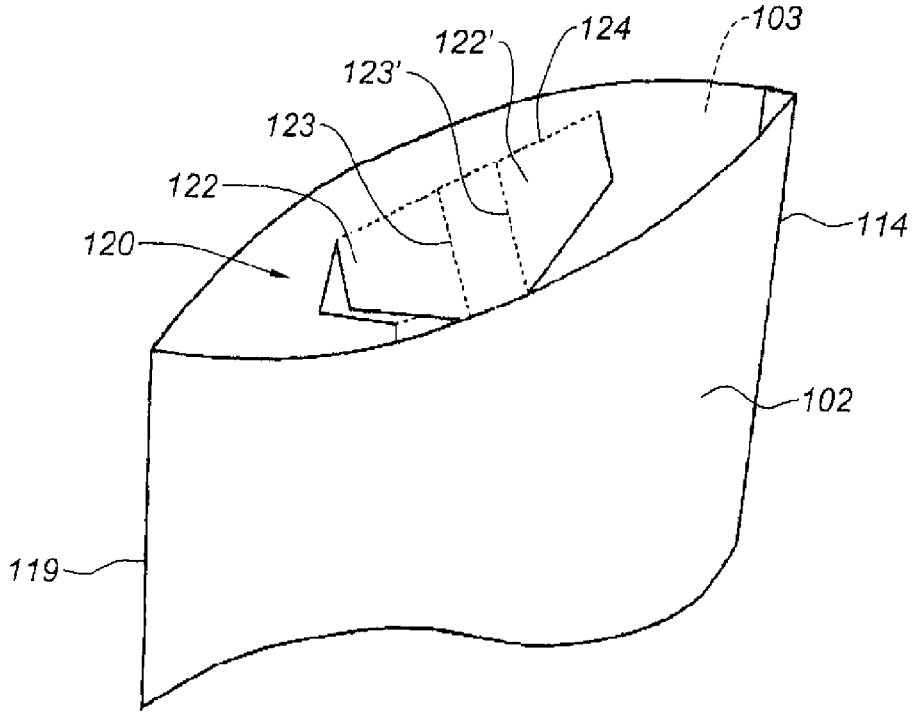
FIG. 13 is a perspective view of the upper panels of FIG. 11, during deployment.

With the column 101 collapsed, the two blank parts 102, 103 flat, their rear faces 118 against one another, the pairs of panels 104, 105 also folded down on top of one another along the fold lines 106, the column 101 is deployed by manually stressing the blank parts 102, 103 by pressing on the side edges 114, 119, which brings the latter closer together and causes the blank parts 102, 103 and, with them, the display faces 111, 112, to curve. Concomitantly, the inserts 121, folded along their fold line 124 (FIG. 13), are also unfolded until they lie flat (FIG. 12). Then, maintaining the pressure on the side edges 114, 119 of the column, shaking the medium slightly if necessary, the lever parts 122, 122' of the inserts are made to pivot automatically, or semi-automatically, under their own weight, into their locking position (FIG. 11). With the holding inserts 121 thus locked in their flat state by the levers 122, 122', the pressure on the side edges 114, 119 can be released; the inserts 121 keep the display faces 111, 112 curved.

Collapsing the Column

The column 101 is turned upside down to cause the lever parts 122, 122' to pivot in the other direction under their own weight, until the bridges 120 are flat once more (FIG. 12). This allows the inserts 121 to be folded along their fold line 124, which lies in the same plane as the side edges 114, 119 of the column, and thus allows the blank parts 102, 103 to be collapsed down and flattened, one against the other, before folding the pairs of panels 104, 105 on top of one another along the fold lines 106, on either side, accordion-fashion, and the assembly can then be kept thus folded-up by any appropriate means, for example an elastic member. In the folded state, the fold line 124 is perpendicular to the edges 114, 119.

Figure 14:
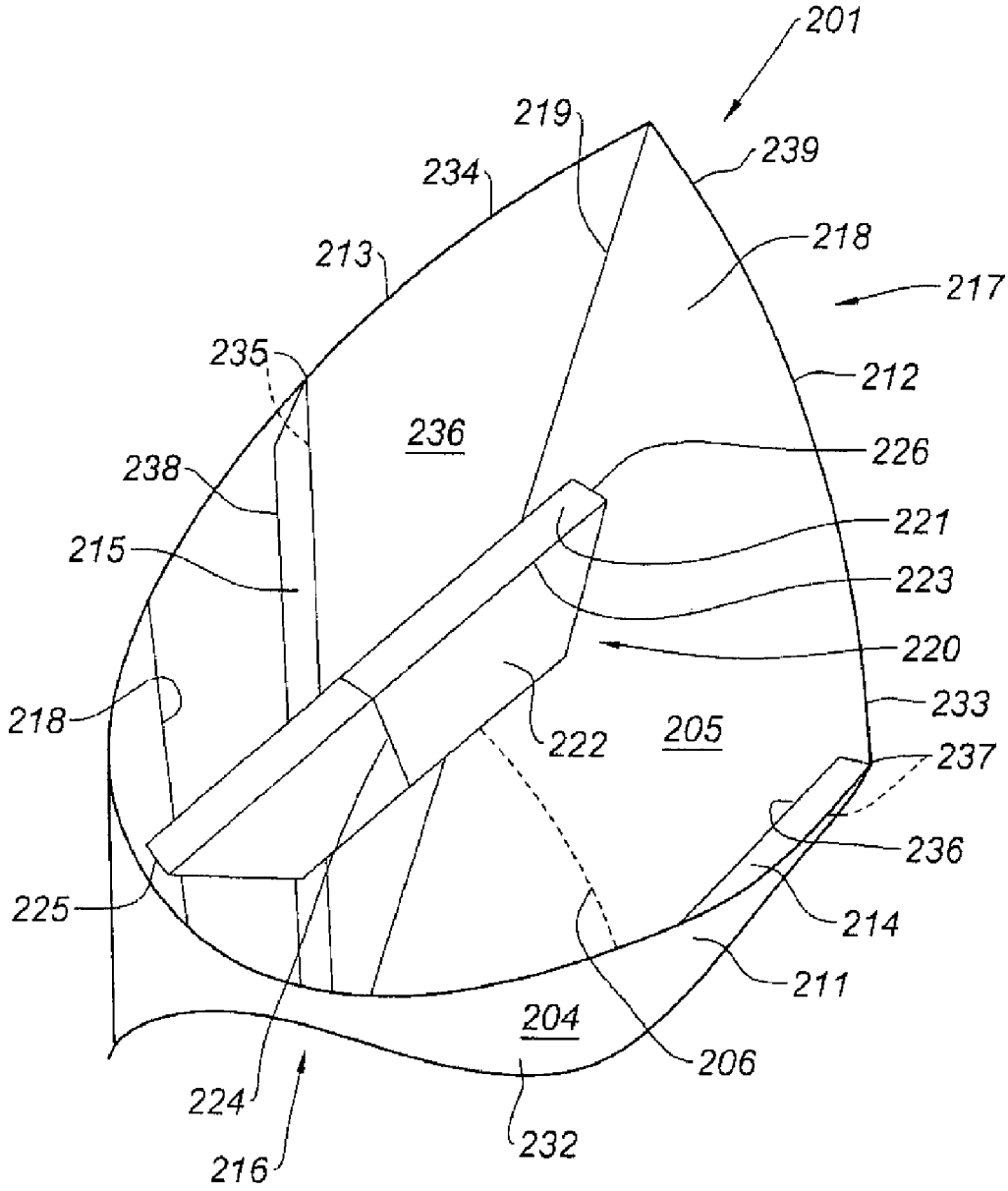
FIG. 14 is a perspective view of the upper panels of a third embodiment of the display medium, after locking.

The embodiment 201 of the display medium of FIG. 14 differs from the above two by virtue of its three display faces, 211, 212, 213 which constitute the front faces of the three blank parts 232, 233, 234, made out of two starting blanks 216, 217 made of a material identical to that used for the columns 1 and 101.

Each starting blank, rectangular in shape, had two free side edges 235, 236 and 237, 238 and two transverse edges 239. A side flap 214, 215 was formed, on each blank, along one of the side edges 236, 238, on the other side of a fold line which, in FIG. 14, lies along the side edge 235, 237. The flaps were also fixed by adhesive bonding, as in the case of the columns 1 and 101.

The starting blanks 216, 217 were folded along two fold lines 218, 219, respectively, parallel to the side free edges 235-238 and delimiting the blank part 234, which is thus in two portions. This third blank part 234 is folded along the border line 235 to collapse the column 201.

Thus, when the column 201 is collapsed but not completely folded up, the two starting blanks 216, 217 are flat against one another, with the blank part 234 folded on itself along the fold line 235.

As with the above two columns, the blank parts 232, 233, 234 of the column 201 are divided into identical panels 204, 205, 206. When collapsed, the column 201 is folded on itself by folding, on top of one another, the groups made up of one panel 204, one panel 205 and a half-panel 206.

The column 201 comprises, at each panel level, a holding and locking/release insert 220 which is partially identical to the inserts 120 of the column 101, without the second lever part 122'. The elements of the inserts 220 which are similar to those of the inserts 120 bear the same references as them, but with the FIG. 1 in the hundreds column being replaced by a 2.

The inserts 220 are mounted between the two blank parts 232, 233, near the side edges 218, 219 of the third blank part 234.

The inserts 220 comprise a holding part 221 and a locking/release lever 222, hinged to the holding part 221 along the fold line 223. After being brought into the flat state, the two holding 221 and locking 222 parts can be folded in half along the fold line 224 which lies in the same plane as the transverse edge 237 and the fold line 235 of the third blank part 234.

Thus, the column 201 is erected and collapsed as follows.

Erecting the Column

With the column 201 collapsed, the three blank parts 232, 233, 234 flat, the blank part 234 in turn folded in half, their rear faces 218 against one another, the groups of panels 204, 205, 206 also folded down on top of one another along the fold lines 206, the column 201 is deployed by manually stressing the blank parts by pressing on the side edges 235 and 237, which brings the latter closer together and causes the blank parts 232, 233 and, with them, the display faces 211, 212, to curve and the blank part 234 to become substantially flat. Concomitantly, the inserts 221, folded along their fold line 224, are also unfolded until they lie flat. Then, maintaining the pressure on the side edges 235, 237 of the column, shaking the medium slightly if necessary, the lever parts 222 of the inserts are made to pivot automatically, or semi-automatically, under their own weight, into their locking position. With the holding inserts 221 thus locked in their flat state by the levers 222, the pressure on the side edges can be released; the inserts 221 keep the display faces 211, 212 curved and the face 213 only barely curved, practically flat.

Collapsing the Column

The column 201 is turned upside down to cause the lever parts 222 to pivot in the other direction under their own weight, until the bridges 220 are flat once more. This allows the inserts 221 to be folded along their fold line 224, which lies in the same plane as the side edges 235, 237 of the column, and thus allows the blank parts 232, 233 to be collapsed down and flattened, one against the other, and the two halves of the blank part 234 to be folded on top of one another, outside the blank parts 232, 233, before folding the groups of panels on top of one another along the fold lines 206, on either side, accordion-fashion, and the assembly can then be kept thus folded-up by any appropriate means, for example an elastic member.

Figure 15:
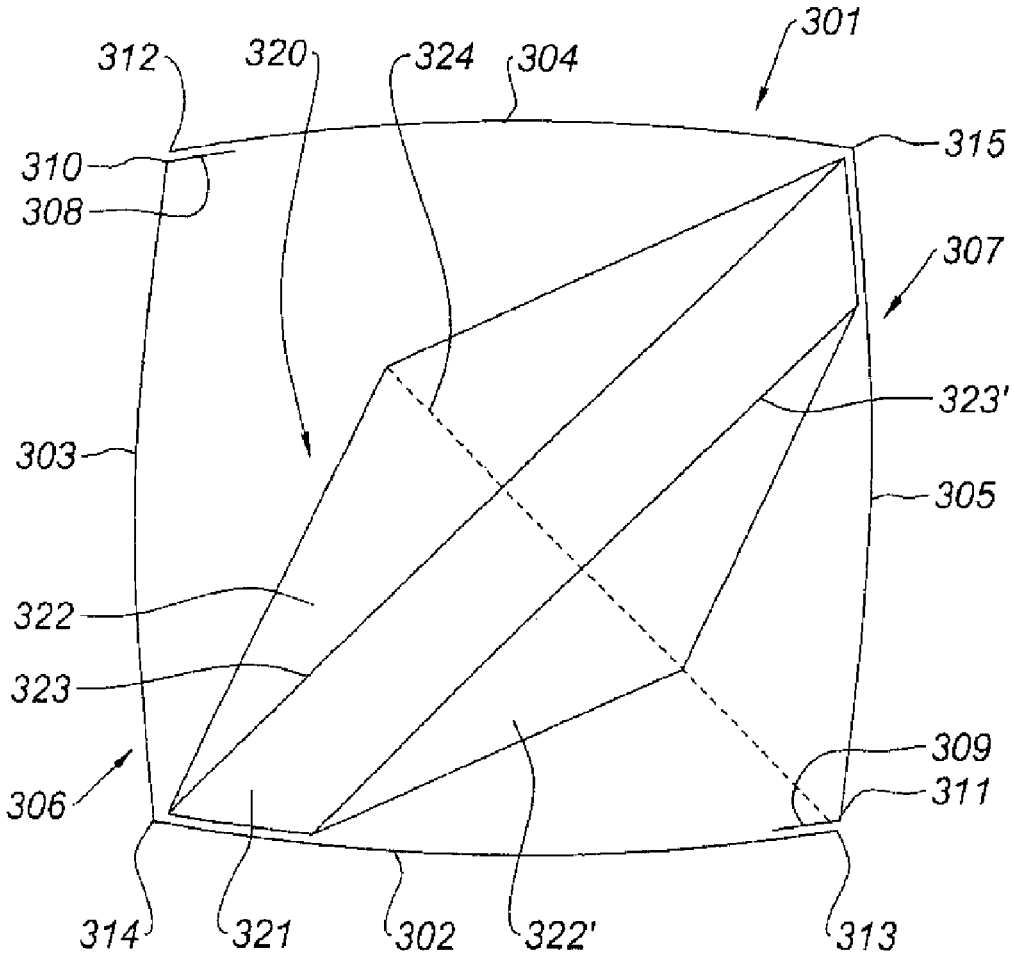
FIG. 15 is a view from above of a fourth embodiment of the display medium, after deployment and locking.

The embodiment 301 of the display medium of FIG. 15 differs from that of FIG. 14 by virtue of its additional fourth display face. The four faces 302, 303, 304, 305 are made out of two starting blanks 306, 307, fixed together by again adhesively bonding a flap 308, 309, folded along a fold line forming a border 310, 311, of one of the starting blanks 306, 307, onto an end side strip adjacent to a side edge 312, 313 of the other of the starting blanks 307, 306. The starting blanks 306, 307 were folded in half along the two fold lines forming side borders 314, 315 for the column, separating the faces 302, 303 and 304, 305.

In the example in question, the four display faces are the same size and are such that, when the column medium 301 is deployed, they are still stressed and in this case only slightly curved and, in any case, prevented from becoming deformed, concave, towards the inside of the column. This is what is meant by "curved" here.

Thus, the column 301, when deployed, has a very slightly curved square cross (horizontal) section.

Like the other columns, the column 301 is divided into groups of four same-level panels, two adjacent groups being separated by four fold lines.

The holding and locking/release inserts 320 of the column 301 again act at various different points along (the height of) the column and are relatively similar to those 120 of the column 101, with their bonding flaps, their holding part 321 and their two locking/release parts 322, 322' hinged to the holding part 321 along fold lines 323, 323', one 323 of which lies in the same plane as the opposite folds/borders 314, 315 while the other 323' is parallel to it and in this case lies within the dihedron formed by the blank parts 302, 305. The three holding and locking/release parts 321, 322, 322' can be folded in half along a fold line 324 lying in the same plane as the opposite side edges 310-313.

The locking/release lever portions 322, 322' are in this case not trapezoidal but triangular.

The column 301 is erected and collapsed in exactly the same way as the other columns.

Several embodiments of the information display medium have been described, with two, three or four display faces. Naturally, the number of display faces must not be considered a feature that limits the scope of the present application.

The invention claimed is:

1. An information display medium having;

at least two display faces, one display face provided on each of two blank parts made of a substantially rigid and foldable material, the blank parts being arranged so that stressing the blank parts stresses the display faces, a plurality of holding inserts, which act at various different points along said blank parts, being provided to keep the blank parts stressed, wherein the blank parts of the display faces are joined together by their edges, each holding insert is mounted between the blank parts in a variable position that switches between a position in which the medium is collapsed and a holding position in which the display faces of the blank parts of the medium are kept in the stressed state, each insert comprising means for locking it in a holding position, and wherein each insert comprises a bridge made of substantially rigid, foldable material designed to be folded on itself along at least two secant fold lines therein.

2. Medium according to claim 1, wherein the means for locking the holding insert is also designed to release it from its holding position and allow the blank parts to be flattened and the medium to be collapsed.

3. Medium according to claim 1, wherein a first bridge portion extending on one side of one of the two fold lines is fixed to the blank parts, the other of the two fold lines being substantially parallel to the edges of the blank parts and lying in the same plane as these edges, and wherein a second bridge portion extending on the other side of said fold line comprises the locking means and constitutes a lever for locking/releasing an insert portion of the bridge in/from its holding position.

4. Medium according to claim 3, wherein there are two display faces on the two blank parts.

5. Medium according to claim 4, wherein the two blank parts are made out of a single blank, one fold line of which constitutes an edge of each of the two blank parts, and wherein two strips of the blank adjacent to the free edges of the blank parallel to the fold line are fixed to one another.

6. Medium according to claim 5, wherein the two strips of the blank adjacent to the free edges of the blank parallel to the fold line are fixed to one another by adhesive bonding.

7. Medium according to claim 3, wherein the lever comprises means for automatically folding along said one fold line in one direction or the other.

8. Medium according to claim 7, wherein the type of material used to make the bridge is determined so as to allow the lever to fold under its own weight.

9. Method for collapsing the information display medium according to claim 3, the method comprising:

pivoting the lever portions of the bridges into the position for releasing holding portions so as to render the bridges flat, then, as the bridges can fold on themselves along a fold line of the at least two secant fold lines which lies in the same plane as the edges of the blank parts, collapsing the two blank parts down on top of one another and folding the medium up.

10. Collapsing method according to claim 9, wherein the lever portions are made to pivot by turning the medium upside down.

11. Medium according to claim 1, wherein a first bridge portion extending on one side of a first of the two fold lines is fixed to the blank parts, the other of the two fold lines lying in the same plane as the edges of the blank parts, perpendicular to these edges in the folded state, and wherein a second bridge portion extending on the other side of said fold line comprises the locking means and constitutes a lever for locking/releasing an insert portion of the bridge in/from its holding position.

12. Medium according to claim 11, wherein the bridge further comprises a third fold line, the third fold line and the first of the two fold lines delimiting opposing edges of the first bridge portion, and a third bridge portion constituting a locking/release lever extending on a side of the third fold line opposite the first bridge portion.

13. Medium according to claim 11, wherein there are at least three display faces and at least three blank parts made out of two folded starting blanks.

14. Medium according to claim 13, wherein there are three display faces and the bridges are mounted between two blank parts near the side edges of the third blank part.

15. Medium according to claim 13, wherein there are four display faces and the bridges are designed to be folded along the at least two secant fold lines lying in the same planes as the opposite side edges, respectively, of the medium.

16. Method for erecting the information display medium according to claim 1 wherein, after unfolding the medium, the method comprising:

stressing its blank parts to stress the display faces, unfolding the bridges and rendering them flat, and then pivoting lever portions of the bridges that comprise the locking means into a position for locking the bridges.

17. Erection method according to claim 16, wherein the lever portions are made to pivot by shaking the medium slightly.

* * * * *